US005279226A

United States Patent [19]

Ritchie et al.

[11] Patent Number: 5,279,226

[45] Date of Patent: Jan. 18, 1994

[54] SAFE-ARM INITIATOR

[75] Inventors: Robert S. Ritchie, Valencia; John A. Sudick, Castaic, both of Calif.

[73] Assignee: Special Devices, Incorporated, Newhall, Calif.

[21] Appl. No.: 972,235

[22] Filed: Nov. 4, 1992

[51] Int. Cl.[5] ..... F42C 15/40; F42C 15/34

[52] U.S. Cl. ..... 102/254; 102/262

[58] Field of Search ..... 102/254, 255, 262, 263, 102/275.11

[56] References Cited

U.S. PATENT DOCUMENTS

| | | | |
|---|---|---|---|
| 2,725,011 | 11/1955 | Sundermann et al. | 102/244 |
| 3,306,207 | 2/1967 | Becker et al. | 102/254 |
| 3,500,747 | 3/1970 | Parker | 102/254 |
| 3,618,527 | 11/1971 | Kilmer | 102/254 |
| 3,658,009 | 4/1972 | Allen | 102/254 |
| 4,278,026 | 7/1981 | Hibbs et al. | 102/254 |
| 4,424,746 | 1/1984 | Boliau | 102/254 |
| 4,592,281 | 6/1986 | Nagennast | 102/254 |
| 4,854,239 | 8/1989 | Van Sloun | 102/254 |
| 5,168,122 | 12/1992 | Furst et al. | 102/262 |

FOREIGN PATENT DOCUMENTS 1276510 8/1968 Fed. Rep. of Germany ... 102/202.5

*Primary Examiner*—David H. Brown

*Attorney, Agent, or Firm*—Robert Louis Finkel

[57] ABSTRACT

A pair of explosive detonators are recessed in the end of a cylindrical body containing a permanent magnet, which serves as the rotor in a brushless, bi-directional torque motor enclosed in a housing. A reversible positioning current causes the motor to rotate the body between armed and safe positions and thereby establish and interrupt axial explosive transfer paths from the detonators to a corresponding pair of explosive transfer lines ported through the housing cover. An internal switching circuit disables the detonators when the body is in the safe position and passes a firing current to them when the body is in the armed position. A detent ring secured to the rotatable body, and a pair of spring-loaded detents in the housing index the rotatable body in the armed and safe positions and prevent its accidental rotation. Mechanical safing means are provided for manually overriding an electrical arming signal.

9 Claims, 4 Drawing Sheets

FIG. 7a
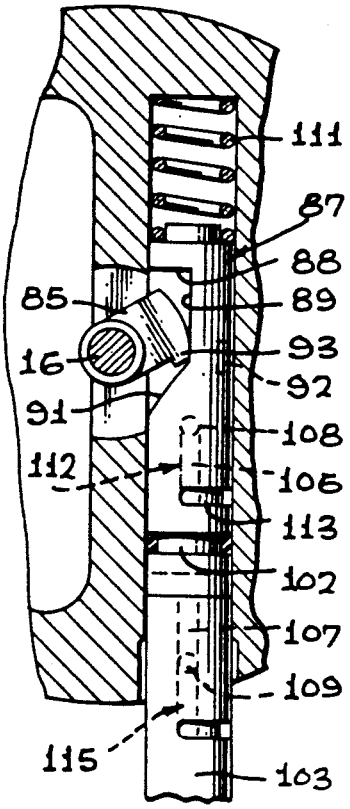
FIG. 7b
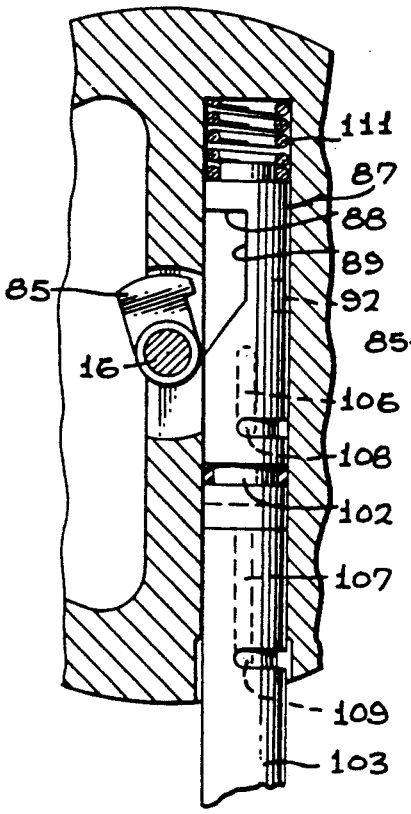
FIG. 7c
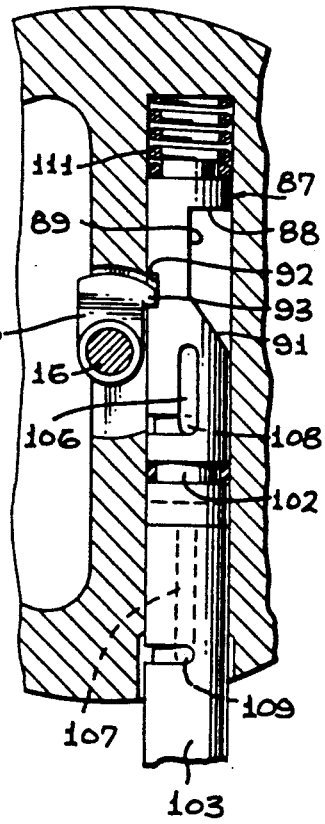
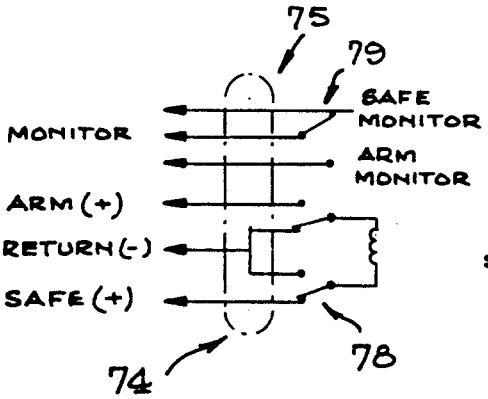
FIG. 8a
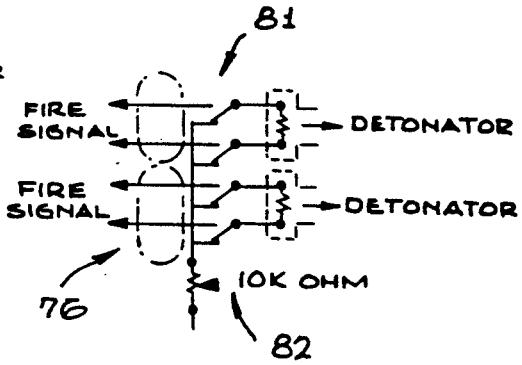
FIG. 8b

SAFE-ARM INITIATOR

BACKGROUND OF THE INVENTION

1. Field of the Invention

This invention relates to safe-arm initiators for explosive devices, and more particularly to firing-type explosive initiators incorporating electromechanical safing and arming means. Still more particularly, it is concerned with a remotely operated initiator of the class described which, when either safed or armed, can be relied on to remain in that state unless and until commanded to assume the alternate status, even in the event of a control power failure.

2. Prior Art

Explosive initiators having internal firing means and integrated safe-arm capacity are well known. The safing and arming mechanisms employed in these devices take a variety of forms, but they are all designed to prevent or effectively impede the propagating of the output of the initiator's primary charge to the explosive train. The basic design criteria for the safe-arm mechanism are dictated to a great extent by the characteristics of the primary pyrotechnics charge used in the initiator.

The overwhelming majority of the "explosive cartridges" employed to achieve initial reaction in explosive initiators are in reality pressure charges. The propellant in a pressure cartridge burns at a relatively low velocity of up to about 400 meters per second, and although the velocity increases with pressure, it can be controlled. Of major concern when designing safe and arm devices using this class of pyrotechnic materials are the requirements for flame travel restriction and pressure containment. Typically, such devices employ specially constructed sealed enclosures, fixed mechanical barriers, and through-bulkhead actuators in their safing and arming designs.

In a true detonation reaction on the other hand, extremely rapid burning of the explosive material produces a supersonic shock, or detonating, wave in the explosive substrate. The detonating velocity in such materials is usually between 2,000 and 9,000 meters per second and is substantially unaffected by pressure. Commonly in such devices, detonation energy is transferred from the detonator to the end of an explosive transfer line by the physical impact of shrapnel. Small particles, expelled from the end of the detonator cartridge at supersonic velocity, impact the end of the transfer line producing a shock wave and subsequent detonation of the explosive train. Safe and arm designs for initiators using this type of pyrotechnic material are principally concerned with the relative geometry between the detonating charge and the pick-up component. Heat and pressure containment is of little significance. The subject invention is directed primarily, though not exclusively, to initiators of this class.

The prior art is replete with safing and arming mechanisms for such initiators. Generally, they employ an assembly including moveable components for mechanically disrupting or blocking the propagation path downstream of the initiating charge. Typically, a more or less conventional electromechanical solenoid or relay, in combination with appropriate switches, ratchets, linkages, levers, cams, clutches, springs, and the like, selectively positions the moveable components to achieve the safe or armed condition.

These prior art safe-arm mechanisms suffer from several deficiencies. For one, since by their nature, solenoids and relays are capable of only limited, unidirectional motion, the control they can exert over the movement of the initiator's components is limited. For another, these devices and their accessories tend to be relatively bulky and heavy. Some are so elaborate that initiators incorporating them require specially augmented detonators or booster charges simply to assure bridging of the explosive transfer gap. For still another, not unexpectedly, their complexity imposes a high price on their manufacture and maintenance, and an even higher one on their reliability.

To afford some of the utilities inherent in the larger, more complex safe-arm systems in a more compact, less elaborate device, initiators of the type disclosed in U.S. Pat. No. 3,500,747 have been developed. These employ electromagnets to cause rotation of an out-of-line ignition bead or primary charge housed within a barrel-like rotor into alignment with an explosive output charge. While electromagnetically operated initiators of this type offer a number of advantages, heretofore their use has been limited by their lack of suitable means for reliably retaining the charge-bearing rotor in the safe and armed positions.

Commonly in such devices, the torque generated by a pair of opposed electromagnets is employed to hold the rotor against a mechanical stop and thereby both position and retain the charge. Continuous operation of an electromagnet under a load, however, consumes power and generates heat. Adapting this type of electromagnetic control for use in arm and fire systems poses significant power consumption and heat dissipation problems.

For many applications, such as missile launching, and ordnance fire control, it is desirable, if not essential, that the initiator's safing and arming mechanism be designed to remain in, or return itself to, the safe condition in the event of a loss of arming power. Such fail-safe devices are well known and in common use. For other applications, however, for example, solid rocket motor thrust termination and vehicle destruction in conjunction with space launch boosters, ballistic missiles, remotely piloted target aircraft, and the like, it is equally important to provide a firing mechanism which will remain armed and operational in the event of the loss of control power. Conventional fail-safe devices are neither designed, nor readily adaptable, to satisfy this requirement. In the case of those employing driving means, such as return springs, pressure accumulators, or the like, for returning components to the safe condition in the event of a loss of power, the provision of an override feature would defeat the very purpose of the fail-safe mechanism. Devices of the type exemplified by U.S. Pat. No. 3,500,747, which depend on the torque generated by an electromagnet to position and retain the critical components, cannot be relied on to remain in the safe or armed condition in the event of a control power failure.

One of the objects of the invention is to provide an electromagnetically operated safe-arm firing type explosive initiator, which affords the advantages, and overcomes the deficiencies, inherent in the prior art safe-arm devices.

Another object is to provide an electromechanical explosive initiator of the type described, which can be repeatedly selectively driven to the safe and armed positions and which will remain stable in either position in the event the electrical driving power fails.

Yet another object is to provide a safe-arm firing initiator which utilizes a rotatable body, rather than pivoting or translating means, to establish and interrupt the explosive transfer path between an internal detonator and an external explosive transfer line.

A more particular object is to provide a device of this type, which does not rely on driving the rotatable body hard over against a mechanical stop for maintaining the device in the safe or armed condition.

Still another object is to provide a safe-arm initiator incorporating an electromagnetically controlled rotatable body, which includes resilient detent means for precisely positioning and reliably retaining the rotatable body in both the safe and armed positions.

A further object is to provide a safe-arm firing initiator of the rotatable body type which is highly resistant to operationally encountered vibration and shock.

A still further object is to provide a remotely operable safe-arm initiator having a manually operable safing mechanism for reliably overriding the arm command and securing the device in the safe condition.

An additional object is to provide in an initiator having manual safing means a visual indicator for reliably determining the condition of the safe-arm mechanism.

Yet a further object is to provide a safe-arm initiator satisfying all of the foregoing objects that is comparatively inexpensive to manufacture and requires no maintenance or repair in the field.

Other objects will become apparent from the following summary of the invention and detailed description of its preferred embodiment.

SUMMARY OF THE INVENTION

The subject invention utilizes a rotatable body containing a permanent magnet, which serves as the rotor in a brushless, bi-directional torque motor, to establish and interrupt the explosive transfer paths from a pair of internal detonators to a corresponding pair of external explosive transfer lines.

The motor includes a wire-wound torroidal stator enclosed in a housing. The explosive transfer lines are connected to transfer passages extending axially through the housing cover. The rotatable body is mounted for concentric rotation within the stator, and in addition to the magnet, contains the detonators.

The detonators are imbedded axially in the end of the rotatable body in position for operative alignment with the explosive transfer passages. When the detonators and the transfer passages are in operative alignment, the device is in its "armed" position. Rotating the rotatable body until the detonators and transfer lines are no longer in operative alignment places the device in the "safe" position.

As will be discussed shortly, for practical reasons the typical rotational displacement between the armed and safe positions is from about 70° to 90°.

The torque motor defined by the stator and magnet-bearing rotatable body is capable of producing bi-directional torque; hence, the device has no need for a return spring. In operation, it is driven in both directions between the safe and armed positions solely by electrical command. The loss of arming or safing power has no effect on its status.

To achieve repeatable, completely reliable, accurate positioning of the device in response to positioning commands, the invention incorporates a novel detent arrangement. This mechanism captures and retains the rotatable body in the commanded position. Equally importantly, it insures that once safed or armed, the device will remain in that condition until commanded to change its status.

Electrical circuitry within the housing controls the positioning and firing functions in response to remotely generated command signals. The circuit logic and switching arrangement enable the device to be set up for a variety of positioning and firing modes. In addition to the protection afforded by the mechanical disruption of the explosive propagation path, in the safe position electrical security is furnished as well by the provision in the circuitry of means for isolating the detonators from external electrical inputs and maintaining a short circuit and internal ground across the detonators' bridgewires.

For added protection in the unlikely event of accidental firing of the detonators while they are in the safe position, a pair of cavities are provided in the housing to contain the explosive output of the detonators. Increasing the available free volume reduces the pressure within the housing and eliminates the danger of potentially catastrophic blow-by of the explosive products.

To facilitate the inspection of the device in the field and insure the safety of nearby personnel, a manually operated safing mechanism is provided. A removeable safing pin inserted into the housing is used to drive the rotatable body into the safe position. The device can only be safed manually. It cannot be armed by means of the safing pin. Arming can be accomplished only through operation of the torque motor. To prevent an inadvertently applied electrical control signal from arming the device accidentally while it is being serviced, the manual safing mechanism is designed to lock the rotatable body in the safe position. It remains locked until the safing pin is withdrawn from the casing. For further protection against accidental arming, the safing mechanism is provided with a command-override feature which prevents the pin from being removed from the casing while an electrical arming signal is being applied to the device.

For use in conjunction with the manual safing mechanism, a visual status indicator is installed in the top of the housing to provide positive indication of the status of the device. Since the visual indicator allows the viewer to see the rotatable body itself, the invention affords service personnel an extremely high degree of confidence in the status indication.

For a fuller understanding of the invention, reference is made to the following detailed description of the embodiment illustrated in the accompanying drawings, in which:

BRIEF DESCRIPTION OF THE DRAWINGS

FIG. 7a is a fragmentary, partially cut-away view, taken generally along the line 7—7 of FIG. 3, illustrating the manually operated safing mechanism with the device in the armed condition;

FIG. 7b is a fragmentary, partially cut-away view illustrating the manually operated safing mechanism of FIG. 7a with the device in a safe, non-energized condition;

FIG. 7c is a fragmentary, partially cut-away view illustrating the manually operated safing mechanism of FIG. 7a and 7b with the device in the safe, energized condition;

FIG. 8a is a schematic diagram illustrating the safe-arm positioning circuit of the invention; and FIG. 8b is a schematic diagram illustrating the firing circuit of the invention.

Wherever practicable, the same numeral is used to identify identical or substantially similar features appearing in the several figures.

DETAILED DESCRIPTION OF THE PREFERRED EMBODIMENT

Figure 1:
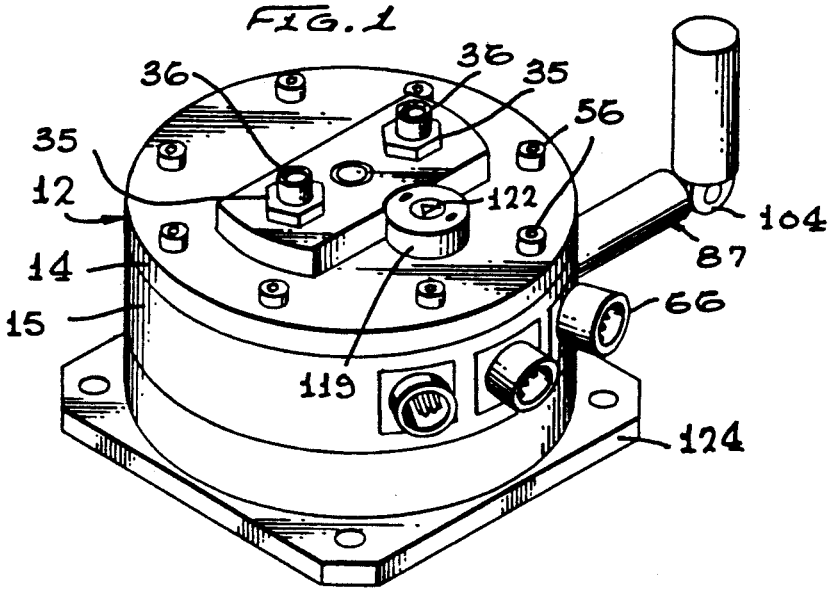
FIG. 1 is a top perspective view of a safe and arm device in accordance with the invention.

Referring to FIGS. 1-5, a rigidly mounted, wound-field, field, two pole torroidal stator 11 (not shown in detail) is enclosed in a housing 12. Stator 11 is a precisely formed cylinder of cast or laminated iron. Conventionally, a torroidal field coil comprising two or more layers of copper wire is wound uniformly around the cylinder on each side of a pair of diametrically opposed barriers which form the stator poles.

Precision bearing assemblies 13 in the cover 14 and midbody 15 of housing 12 support the upper and lower ends of the fixed axial shaft 16 of a cylindrical body 17 and permit the body 17 to rotate concentrically within stator 11. A diametric groove 21 is provided in body 17 to receive a closely conforming permanent magnet 22 conveniently built up from a machinable iron core 23 to which permanent magnetic pole pieces 24 of samarium-cobalt or the like are bonded. A bore 25 through core 23 allows magnet 22 to be mounted to shaft 16 for insertion into groove 21. Magnet 22 is firmly retained by frictional contact with the walls of groove 21, but if desired, it may be bonded, or releasably secured by other conventional means to insure that body 17 and magnet 22 are, for all practical intents and purposes, a rigid monolithic unit.

Magnet 22 and stator 11 define a bi-directional DC torque motor. With magnet 22 an integral part, body 17 effectively represents the rotor. Most of the magnetic flux developed within magnet 22 passes directly across the narrow air gap separating the pole pieces 24 and the stator 11, and through the copper windings that lie under the faces of the pole pieces 24. The stator core provides the return path for this flux. As is well understood, a current flowing in the stator windings produces a torque acting on magnet 22 and, therefore, on body 17. This torque is constant at every position of magnet 22 for which the pole faces cover conductors of the same polarity. Advantageously, this means that the torque sensitivity, that is, the torque developed per ampere of input current, is nearly linear over a significant range of rotational displacement. Additionally, since there are no stator slots to cause reluctance variation in the air gap, the torque developed by the motor is ripple-free and smooth. The angular region of constant torque sensitivity depends on the span of the rotor pole faces, the span of the stator coils, and the fringe flux that leaks out of the sides of the rotor magnet. Accordingly, in constructing a safe-arm device embodying the subject invention, it must be borne in mind that while a narrow rotor magnet affords a wider useful excursion angle, there is less flux and therefore lower torque available for driving, and in particular for overcoming the inertia of, magnet 22 and the other components of the rotor.

One of these components is the initiating charge. For most applications, one detonator should suffice to activate the explosive mechanism, and the invention is adaptable to single-detonator firing devices. Sound practice, however, calls for the provision of alternative actuating means, and with the advantages afforded by symmetry as well as redundancy in mind, the preferred embodiment of the invention incorporates two separate detonators operating through parallel firing trains.

Figure 3:
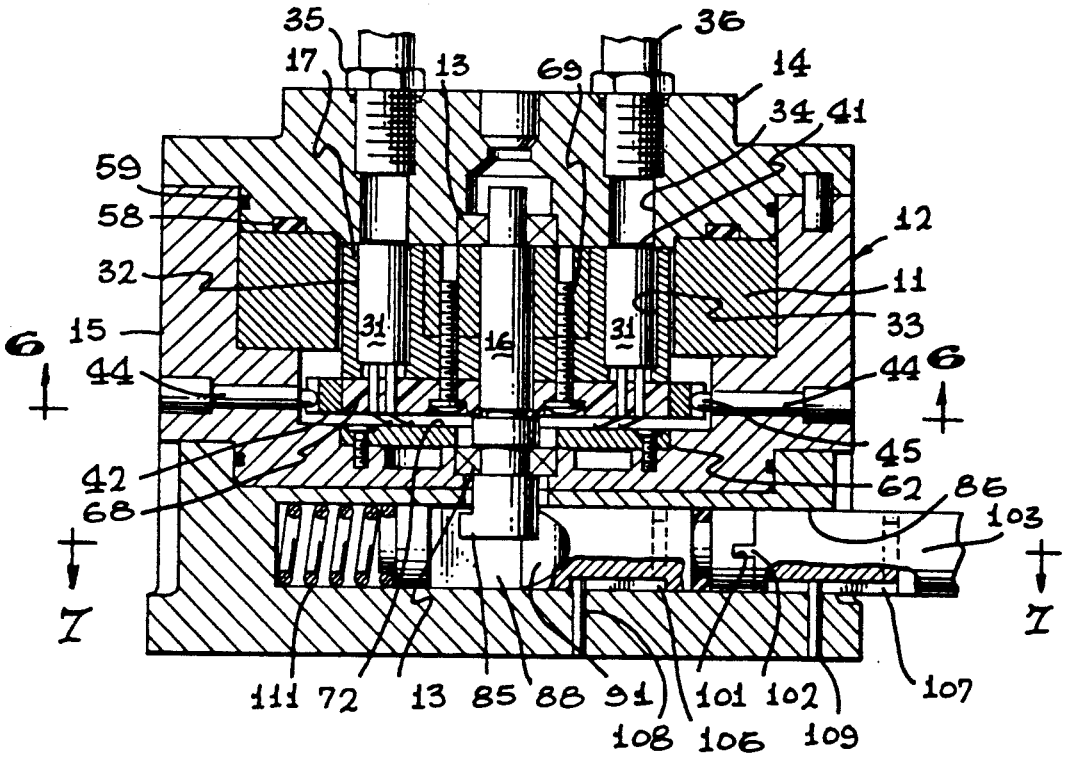
FIG. 3 is a side sectional view taken along the line 3—3 of FIG. 2.
Figure 4:
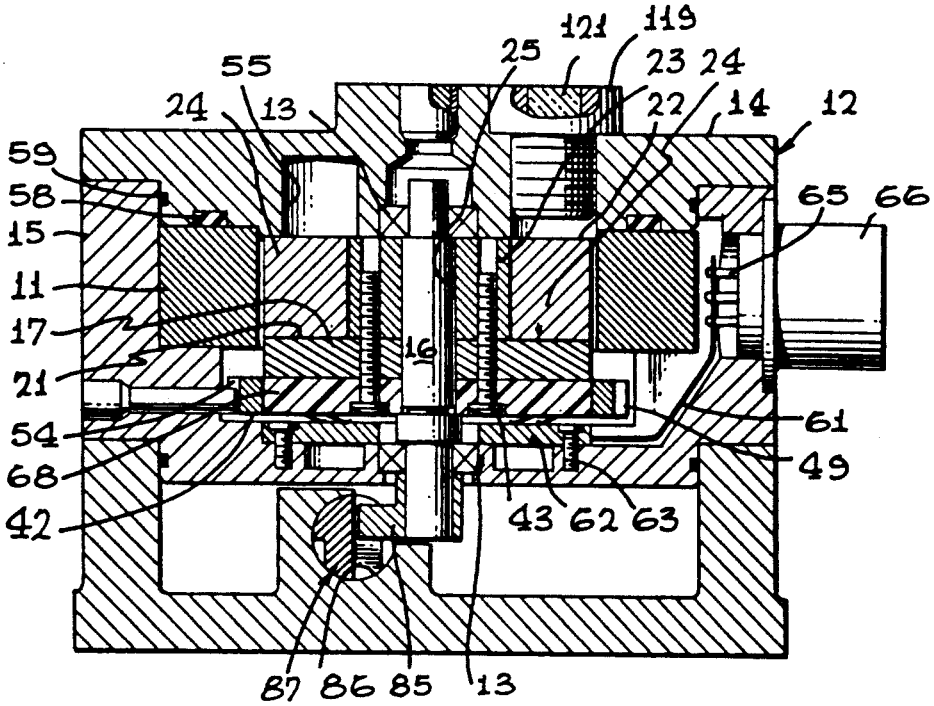
FIG. 4 is a side sectional view taken along the line 4—4 of FIG. 2 with the device in the armed position.
Figure 5:
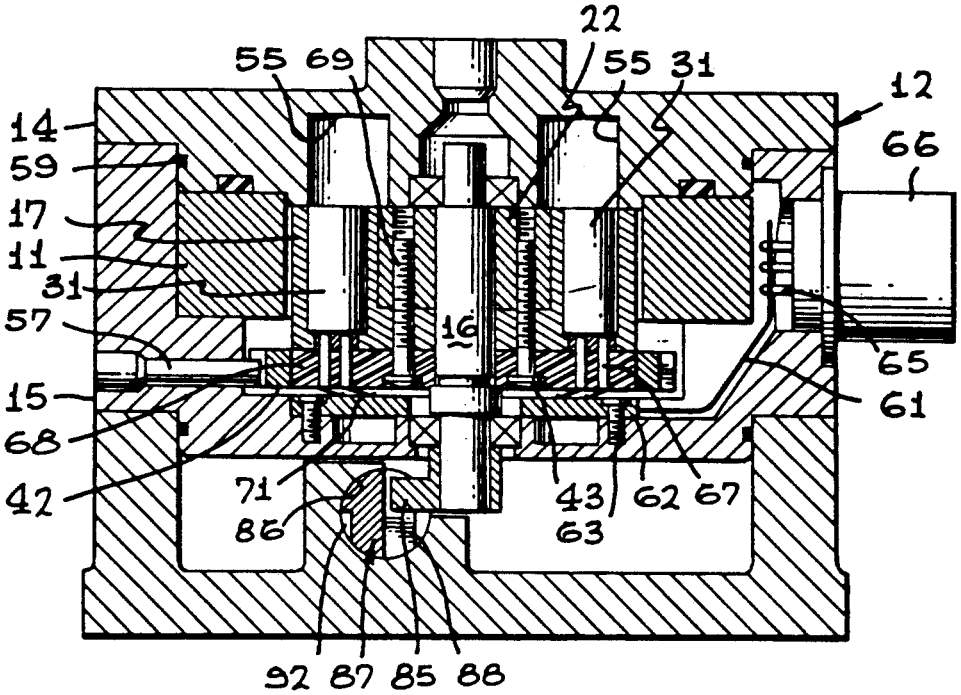
FIG. 5 is a side sectional view taken along the line 5—5 of FIG. 2 with the device in the safe position.
Figure 6:
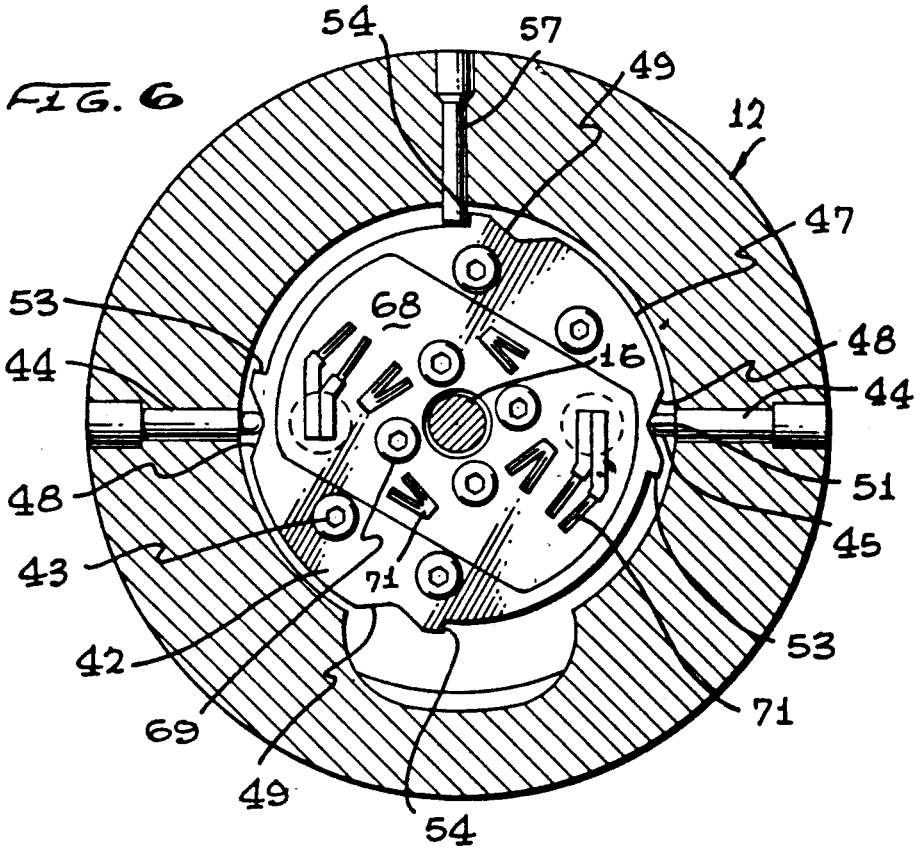
FIG. 6 is an inverted sectional view taken along the line 6—6 of FIG. 3, showing, in particular, the detent ring and switch plate.

Returning to the drawings, and particularly FIGS. 3, 4, and 5, the detonators 31, each typically a pyrotechnic initiator, an explosive output charge, a bridgewire for igniting the initiator, and associated internal circuitry contained in a casing 32, are retained in axial, diametrically spaced receptacles 33 formed in the end of body 17. A pair of axial explosive transfer passages 34 in cover 14 correspond with detonators 31. The outer ends of passages 34 are provided with conventional fittings 35 for coaxial attachment of the receiving ends of explosive transfer lines 36 leading to the pick-up charge, or charges of the explosive system to be activated. Closures, such as thin integral bulkheads 41, hermetically seal the input ends of passages 34 and their associated explosive transfer lines.

Figure 2:
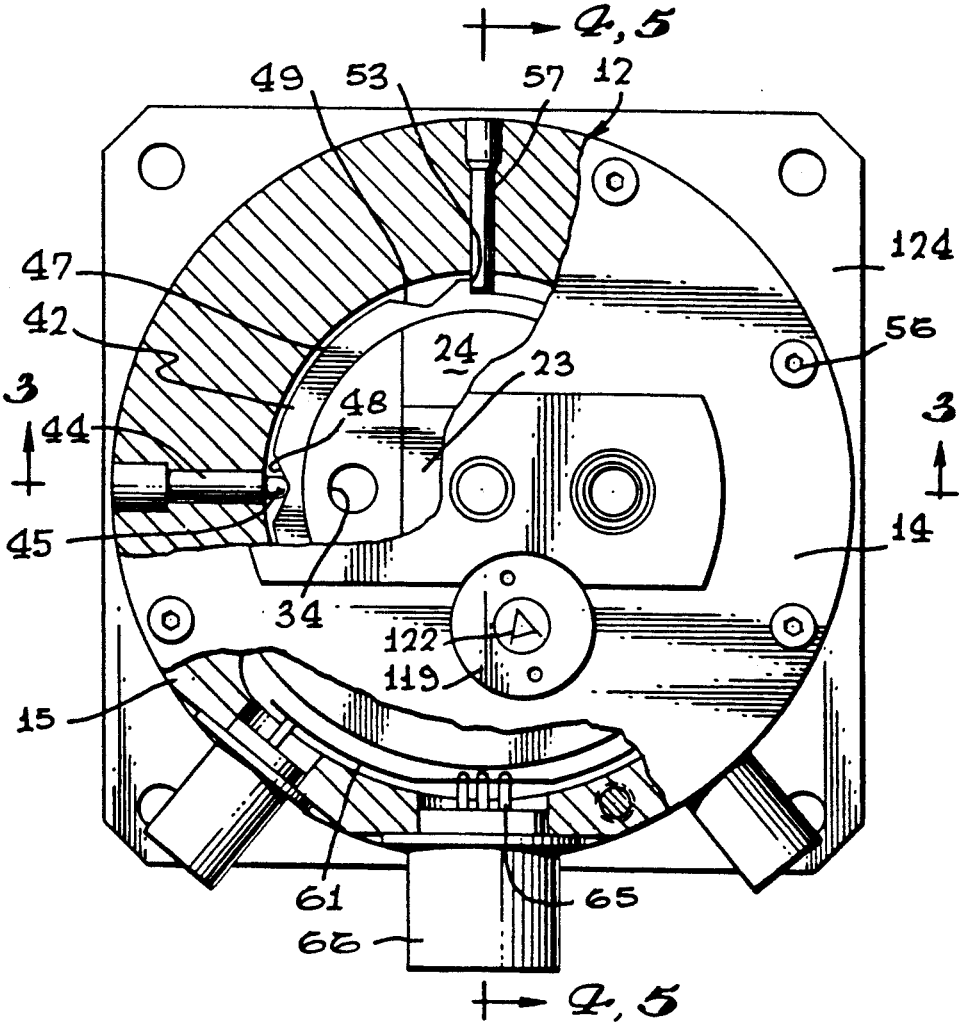
FIG. 2 is an enlarged fragmentary top plan view of the device shown in FIG. 1, with portions cut away to expose its internal structure when the device is in the armed position.

For descriptive purposes, the terms "armed" and "safe" are most conveniently defined empirically. In accordance with the invention, a device is deemed to be armed, or in the armed position, when the axial relationship of a detonator 31 and its firing train, that is, explosive transfer passage 34 and its associated explosive transfer line, is such that detonation of the output charge will result in an effective explosive transfer to the pick-up charge. FIGS. 2-4 show the device in the armed condition.

In the configuration illustrated, the device is designed so that When the body 17 is rotated more than about 5° in either direction from the armed position, effective explosive transfer from the detonators 31 to the explosive transfer lines cannot take place. Under these conditions, the initiator and its components are said to be in the "safe" position. In this embodiment the safe position extends arcuately over a range of about 170°. FIG. 5 shows the device in the safe position.

Although the torque motor can be used to orient and restrain body 17 with respect to the null axis of stator 11, positioning and immobilizing the rotor by this means alone is neither precise, nor reliable in the face of shock or vibration. Driving body 17 against an abutment requires excessive power and creates heat-dissipation problems. Alternative means must be provided for precisely capturing and securely retaining body 17 in the safe and armed positions. To serve these purposes, a detent ring 42 of suitable rigid, durable, non-deformable material is secured to the rotatable body 17 by conventional means, such as machine screws 43. A pair of redundant, diametrically opposed, resilient detents, for example spring-loaded plungers 44, are mounted to the inner wall of housing 12. Their ends 45 ride on the periphery of detent ring 42. The profile, 47 of detent ring 42 is configured with two arcuately spaced pairs of diametrically opposed notches 48, 49 which are designed to capture and retain the radially inwardly-biased plungers 44. Preferably the notches 48, 49 are formed with central recesses 49. The ends 45 of plungers 44 are shaped to conform closely with recesses 49 so as to effectively eliminate shock- or vibration-induced jitter or rotation of body 17. In the embodiment illustrated here, for convenience each of the notches 48, 49 is designed to subtend an arc, or capture angle, on detent ring 42 of approximately 10°. If rotation of body 17 brings a plunger end 45 within that arc, the camming effect of the sides of the notch 48 or 49 on spring-biased plunger 44 insures the capture of end 45 of plunger 43 in recess 49, and the secure retention of body 17 in the safe or armed position associated with notch 48 or 49.

The angular relationship between adjacent notches 48 and 49 determines the angular displacement of detonators 31 and their associated explosive transfer passages 34 in the safe position. Within rather broad limits, the displacement designed into a device made in accordance with the invention is a matter of choice. As previously noted the chemical and physical characteristics of the types of detonators and explosive trains with which this invention is intended to be used allow a device to be designed with an arcuate displacement between detonators 31 and transfer passages 34 of from as little as about 5° to as much as 90°. However, a balancing of the desirability of having the smallest angle to traverse with the rotor, and therefore the fastest reaction time, against the structural space requirements and the security afforded by maximum displacement of the firing train components suggests an optimum displacement of from about 70°, to about 90° between the detonators 31 and their respective explosive transfer passages 34. In the preferred embodiment shown and described here, the arcuate displacement of the components of the firing train in the safe position is about 70°.

To facilitate the capture and retention of plungers 44 in notches 48, 49, as best seen in FIGS. 2, 4, 5, and 6, two pairs of arcuately spaced opposed shoulders 53, 54 are formed in the profile 47 of detent ring 42. Shoulders 53, 54 provide a pair of opposed abutments for stop pin 57 extending rigidly inwardly from the wall of housing 12. Stop pin 57 is positioned to be spaced arcuately a few degrees from shoulders 53 and 54 when the ends 45 of plungers 44 are bottomed in the recesses 51 in notches 48, 49 and body 17 is in the safe or armed position. This arrangement affords body 17 slightly more than 70° of rotation between shoulders 53 and 54, and, as an added safety measure, insures that in moving between the safe and armed positions, detonators 31 pass explosive passages 34 only once.

Cover 14 is tightly secured to midbody 15 by conventional means, such as bolts 56, and housing 12 is hermetically sealed by means of annular "O"-ring 58 and seal 59, thereby virtually eliminating the danger of external blow-by in the event of accidental detonation. Further protection against that possibility is provided by a pair of cavities 55 formed in the underside of cover 14. Cavities 55 are designed to register with detonators 31 when the device is in the safe position. They are sized to provide sufficient free volume to safely contain the combustion products resulting from premature detonation of the initiating charge and reduce the explosive over-pressure to a harmless level.

As seen most clearly in FIGS. 3–6, the electrical circuitry and switches for positioning, firing, and monitoring the initiator are integrated in a rigid-flex circuit 61 terminating in a rigid switch deck 62 mounted to the housing midbody 15 below the rotatable body 17 by conventional means, such as screws 63. Circuit 61 is connected to conventional external power source, remote positioning and firing command, and condition monitoring leads through pins 65 and external couplings 66.

The electrical leads from the initiator, including leads 67 from detonators 31, extend through a rigid contact holder 68 of glass-filled Nylon or other suitable durable insulating material conveniently configured for tight containment within detent ring 42. For added rigidity between contact holder 68 and rotatable body 17, holder 68 is secured to body 17 by bolts 69 or other convenient fastening means. Leads 67 and the other electrical interconnects are soldered or otherwise attached to resilient conductive brushes 7 provided on the underside of contact holder 68. Upon rotation of body 17, brushes 71 make electrical contact with, and draw power from, flush wiper pads 72 formed on the adjacent surface of switch deck 62.

FIGS. **8*a* and 8*b* illustrate schematically the positioning circuitry 74 and condition monitoring circuitry 75, and the firing circuitry 76, of the present embodiment, respectively. In most respects the circuitry is conventional and typical. The positioning circuitry 74 allows rotatable body 17 to be driven in either direction by operating switch 78 to reverse the polarity of the current to the field windings on stator 11. To prevent the body 17 from being driven hard over against shoulders 53, 54 with resulting power drain and overheating, the positioning switch 78 is designed to open the motor command circuit a few degrees before the shoulders 53, 54 make contact with stop pin 57, thus allowing inertia to carry of body 17 to the safe or armed position for capture by the detent mechanism. Typically, as one command loop is opened, the reverse command loop is simultaneously closed to allow the body 17** to be driven in the opposite direction.

Switch 78 is ganged with a switch 79 in the monitoring circuit, in such a way that operation of the positioning switch causes the monitoring circuit to signal the condition of the system to a remote command station.

Switches 81 and 82 in firing circuit 76 are likewise ganged to insure the simultaneous firing of both detonators 31 upon receipt of the firing command. Conventionally, switches 81, 82 may be preset to the firing position, so as to allow movement of body 17 into the armed position to generate the firing command and cause the initiator to fire, or they may be left in the safe, i.e., open position, awaiting movement of body 17 into the armed position, after which their closing fires the initiator.

Referring to FIGS. 1, 3, 4, and **7*a–c*, a cam follower 85 is rigidly mounted to the lower end of shaft 16 on rotatable body 17 and extends radially of shaft 16 into a closed-ended bore 86 formed in the lower body of housing 12. A shuttle 87 is sized to reciprocate and rotate freely in bore 86. An axial cutout 88 in the side of shuttle 87 is configured to present a camming surface 89 containing a ramp 91 to follower 85. A recess 92 is provided in the side of shuttle 87 opposite cutout 88 to receive a dog 93 formed on cam follower 85. Shuttle 87 is effectively immobilized in bore 86 when dog 93 is seated in recess 92**.

The end of shuttle 87 closer to the open end of bore 86 is provided with a transverse groove 101 adapted to receive a tongue 102 formed on the end of a safing pin 103 configure for insertion into bore 86. Shuttle 87 and safing pin 103 are provided with bayonet fitting grooves 106 and 107, respectively, positioned for locking engagement with retaining pins 108 and 109 extending radially inwardly from the wall of bore 86. A compression spring 111 in the closed end of bore 86 urges shuttle 87 toward the open end of bore 86. When the initiator is in the armed condition, shuttle 87 and cam follower 85 are in the positions shown in FIG. 7*a*. In this configuration, with retaining pin 108 captured in the axial segment 112 of groove 106, shuttle 87 is free to travel axially in bore 86, but is prevented from rotating. Cam follower 85 extends radially into cutout 88, and rests in contact with camming surface 89.

To safe the initiator manually, safing pin 103 is inserted into bore 86. Groove 107 is exposed at the end of pin 103 to receive retaining pin 109 and serves as a guide to orient pin 103 for insertion of tongue 102 into groove 101. Applying sufficient axial force to the outer end 104 of safing pin 103 to overcome the resistence of spring 111 causes shuttle 87 to move inwardly of housing 12 and forces cam follower 85 riding on ramp 91 to rotate shaft 16, and thus body 17, in the direction (counterclockwise in FIG. 7*a*) toward the safe position. Once body 17 has been rotated to the point at which plungers 44 engage the notches 49 in detent ring 42, the springs in plungers 44 rotate body 17 the last few degrees into the safe position and retain it there until the torque motor is commanded to arm the device.

As illustrated in FIG. 7*b*, when the initiator is in the safe condition, cam follower 85 is designed to be clear of cutout 88. To complete the manual safing operation, safing pin 103 is rotated clockwise 180° to align recess 92 with dog 93 on follower 85.

While the initiator remains in the safe condition, manually rotating safing pin 103 180° in the counterclockwise direction returns retaining pin 109 to its original alignment with the axial segment 115 of groove 107 and allows pin 103 to be withdrawn from bore 86.

If, however, through accident or inadvertence an arming command signal has been transmitted to the initiator and the torque motor has been energized, the first few degrees of rotation of body 17 will bring dog 93 into engagement with recess 92. As seen in FIG. 7*c*, the capture of dog 93 prevents body 17 from rotatating further, and thus effectively overrides the arming command. Additionally, as long as the torque motor remains energized and maintains dog 93 in engagement with recess 92, shuttle 87 and safing pin 103 are immobilized, and pin 103 cannot be withdrawn from bore 86.

Upon the arming power being cut off, the torque produced by the interaction of spring-biased plungers 44 (which have remained within notches 49) and the inwardly directed sides of notches 49 returns the body 17 to its original stable, safe position. Cam follower 85 is rotated to the position shown in FIG. 7*b*, thereby releasing shuttle 87 and permitting safing pin 103 to be removed from the device.

A visual status indicator 119 in the cover 14 allows personnel working on or near the device to ascertain by direct observation whether it is safe or armed. In the embodiment illustrated, a fiber optic system 121 provides a clear view of letters 22 ("S" for safe, "A" for armed) or other status-related indicia displayed on the surface of rotatable body 17.

Typically, a base 124 is provided for mounting the device to the vehicle or other structure with which it is intended to be used. The construction, placement, and orientation of the base 124 and many of the other components and features of the device, for example, the rotatable body 17, the detent ring 42 and plungers 44, the electrical switches and circuitry, the manual safing mechanism, and the visual status indicator 119, can readily be modified.

While we have described the subject invention in terms of a preferred embodiment, it is not to be construed as limited to that construction. One of the significant advantages of the invention resides in the inherent flexibility of its design. The device depicted here is to be regarded as illustrative, and not as limiting or restrictive. It is our intention by this specification to encompass any and all variations of the example we have chosen for purposes of the disclosure, which do not depart from the spirit and scope of the following claims.

We claim:

1. A safe-arm firing type explosive initiator, comprising:

a housing having a generally cylindrical bore therein and a cover;

a pair of diametrically spaced explosive transfer passages extending axially through said cover and communicating with an explosive transfer line;

a torroidal stator fixed in said housing;

a generally cylindrical rotatable body containing a diametrically disposed magnet and a pair of axially disposed detonators corresponding with said transfer passages, said rotatable body being mounted for concentric rotation within said stator between an armed position in which said detonators are in operative axial alignment with said passages and a safe position in which said detonators are arcuately displaced out of operative alignment with said passages;

electrical circuitry contained in said housing, said circuitry including a firing circuit and a positioning circuit, said positioning circuit including electrical windings around said stator;

first switch means responsive to an electrical firing command signal for selectively connecting said firing circuit with a power supply and thereby firing said detonators when said rotatable body is in said armed position;

second switch means responsive to rotation of said rotatable body for disconnecting said firing circuit and said first switch means and grounding said firing circuit when said rotatable body is in said safe position;

third switch means responsive to an electrical positioning command signal for selectively connecting said positioning circuit and said power supply and thereby inducing rotation of said rotatable body;

first detent means on said rotatable body; and second detent means in said housing, said first and second detent means cooperating, when engaged, to urge said rotatable body into said safe and armed positions, and releasably and resiliently to retain said rotatable body in said positions.

2. A safe-arm initiator as recited in claim 1, wherein in said safe position said detonators are arcuately displaced from said explosive transfer lines about 5°–90° and preferably about 70°–80°.

3. A safe-arm initiator as recited in claim 1, wherein in said third switch means includes polarity-reversing means for inducing bi-directional rotation of said rotatable body.

4. A safe-arm initiator as recited in claim 1, wherein:

said first detent means includes an annular ring having opposed pairs of first detents corresponding to said safe and armed positions formed in its periphery; and said second detent means include a pair of opposed second detents mounted in said housing for releasable, resilient engagement with said first detents.

5. A safe-arm initiator as recited in claim 4, wherein said first and second detents have an operative arcuate capture angle of about plus or minus 5°.

6. A safe-arm initiator as recited in claim 4, wherein:

said first detents are indentations formed in the periphery of said annular ring; and said second detents are resilient followers mounted within said housing and adapted to ride the periphery of said ring.

7. A safe-arm initiator as recited in claim 1, comprising mechanical safing means for manually overriding an electrical arming command and reliably retaining said rotatable body in said safe position.

8. A safe-arm initiator as recited in claim 7, wherein said mechanical safing means includes:

a coaxial shaft on said rotatable body;

a shuttle disposed for axial and rotary motion in a bore in said housing adjacent said shaft, said shuttle having an axial cam and a recess ecircumfrentially spaced from said cam formed therein;

a cam follower formed on said shaft, said cam follower having a limb thereon and being oriented to remain clear of said shuttle when said rotatable body is in said safe position, said cam being adapted on axial movement of said shuttle in a first direction to rotate said follower, and thus said rotatable body, toward said safe position, thereby bringing said first and second detents into engagement and causing said rotatable body to be urged by said detents into said safe position;

a receiver in said housing;

a manually operable safing pin insertable into said receiver in releasable engagement with said shuttle, said safing pin being adapted for moving said shuttle axially in said first direction when said cam is in alignment with said cam follower and for rotating said shuttle to position said recess in registry with said limb when said cam follower is clear of said shuttle, whereby rotation of said rotating body, and thus said cam follower, in response to an electrical arming command causes said limb to engage said recess, thereby immobilizing said shuttle;

first retaining means for releasably retaining said shuttle with said recess in registry with said limb, said first retaining means releasing said shuttle in response to rotation of said shuttle;

second retaining means for releasably retaining said safing pin in said receiver while said limb is in engagement with said recess, whereby said safing pin cannot be removed from said receiver while said initiator is receiving an electrical arming command, said second retaining means releasing said safing pin in response to rotation of said safing pin; and resilient means urging said shuttle and said safing pin axially in the direction opposite said first direction and into position for rotation.

9. A safe-arm initiator as recited in claim 8, wherein:

said first and second retaining means include bayonet fittings on said shuttle and said safing pin, and guide pins in said bore and said receiver; and said resilient means includes a compression spring axially disposed in the end of said bore remote from said receiver.

* * * * *